US005269221A

United States Patent [19]

Hachiya et al.

[11] Patent Number: 5,269,221

[45] Date of Patent: Dec. 14, 1993

[54] ROLLER SHIFTING DEVICE FOR PRINTING PRESS

[75] Inventors: Tadashi Hachiya; Masaru Kurihara; Yosuke Nobuta, all of Kanagawa, Japan

[73] Assignee: Kabushiki Kaisha Tokyo Kikai Seisakusho, Japan

[21] Appl. No.: 983,698

[22] Filed: Dec. 1, 1992

[30] Foreign Application Priority Data

Dec. 25, 1991 [JP] Japan ..... 3-356613

[51] Int. Cl.[5] ..... B41F 7/26; B41F 7/40

[52] U.S. Cl. ..... 101/148

[58] Field of Search ..... 101/148, 147, 348, 349, 101/350-352, 363, 207-210

[56] References Cited

U.S. PATENT DOCUMENTS 4,461,208 7/1984 Ghisalberti ..... 101/148

5,158,017 10/1992 MacConnell ..... 101/348 X

FOREIGN PATENT DOCUMENTS 236387 8/1990 Japan .

*Primary Examiner*—J. Reed Fisher

*Attorney, Agent, or Firm*—Ronald P. Kananen

[57] ABSTRACT

A roller shifting device for a printing press comprises first support means for supporting a form dampening roller for shifting the form dampening roller relative to a surface of a plate on a plate cylinder between a first contacting position and a second released position, second support means for supporting a transfer roller for shifting the transfer roller relative to the form dampening roller between a first contacting position and a second released position, third support means for supporting another roller other than the transfer roller and to be contacted with and released from the form dampening roller for shifting the another roller between a first contacting position and a second released position, means for cooperating the first, second and third support means for synchronous shifting between the first and second positions, means for differentiating a shifting stroke and/or direction of the tfirst support means from those of the second and third support means, and actuating means associated with one of the first, second and third means for driving to shift the first, second and third support means in synchronism with each other.

18 Claims, 6 Drawing Sheets

ROLLER SHIFTING DEVICE FOR PRINTING PRESS

BACKGROUND OF THE INVENTION

1. Field of the Invention

The present invention relates generally to a roller shifting device for a printing press. More specifically, the invention relates to a roller shifting device for shifting a plurality of rollers for contacting with and releasing away from the peripheral surface of an form dampening roller, in conjunction with shifting of the inking for contacting with and releasing away from the peripheral surface of a plate mounted on a plate cylinder.

2. Description of the Related Art

In general, an inking device and dampening device in a printing press are provided roller shifting devices for shifting rollers. For example, Japanese patent publication (Kohkohu) No. 2-36387, published on Aug. 16, 1990, discloses such type of the roller shifting device.

The construction of the roller shifting device as disclosed in the Japanese patent publication No. 2-36387 will be briefly discussed with reference to FIG. 11. The shown arrangement includes an form dampening roller 52 and a transfer roller 53. The form dampening roller is supported by a supporting member 56 pivotable about a pivot shaft 54 so that it is shifted to contact with and released away from a surface of a plate (not shown) mounted on a plate cylinder 51. Similarly, the transfer roller 53 is supported by a support member 57 pivotable about a pivot shaft 55 so that it is shifted to contact with and released away from the form dampening roller 52. In addition, the transfer roller 53 is held in contact with a dampening roller 64 which is stationarily positioned and partly disposed within a dampening reservoir 65. Therefore, the transfer roller 53 is shifted along the periphery of the water fountain roller 64.

The supporting members 56 and 57 are linked through a linkage lever 58. The linkage lever 58 is formed with an elongated slot 59 so as to permit displacement of the supporting member 56 relative to the other supporting member 57. An actuation rod 61 of an air cylinder 60 is connected to the supporting member 57.

In the operation for shifting the form dampening roller 52 away from the plate surface and shifting the transfer roller 53 away from the peripheral surface of the form dampening roller, the air cylinder 60 is actuated to retract the actuation rod 61. By this action of the actuation rod 61, the supporting member 57 is initially pulled to pivot in a direction shifting the transfer roller away from the form dampening roller 52. After a shifting stroke corresponding to the stroke of the elongated slot 59 of the linkage lever 58, the retraction force acts on the supporting member 56 to shift the form dampening roller 52 away from the plate surface. Therefore, the magnitude of angular displacement in the pivoting motion of the supporting member 56 becomes smaller than that of the supporting member 57 in the corresponding magnitude to the length of the elongated slot 59.

Upon contacting the form dampening and transfer rollers 52 and 53 onto respective of the mating surfaces, the air cylinder 60 is actuated in the opposite direction to extract the actuation rod 61. Then, the supporting member 57 is initially shifted for the pivoting stroke corresponding to the length of the elongated slot 59. At the end of the initial stroke of action of the actuation rod, the transfer roller carried by the supporting member 57 comes into contact with the form dampening roller 52. Then, according to the further stroke of extraction of the actuation rod 61, the supporting member 56 is pivoted together with the supporting member 57 so as to place the form dampening roller 52 in contact with the plate surface of the plate on the plate cylinder 51.

In such prior proposed construction of the roller shifting device, it is possible to shift the form dampening roller relative to the plate surface in conjunction with shifting of the transfer roller with respect to the form dampening roller. However, it does not shift other rollers contacting with the peripheral surface of the form dampening roller (for example, an intermediate roller 62 and a vibration roller 63). Therefore, these rollers are apt to be maintained in contact with the form dampening roller for a long period. This tends to cause the contact pressure to act on the outer periphery of the form dampening roller via these rollers, i.e. the intermediate roller, the vibration roller or so forth, while the form dampening roller is resting. It is also possible to provide a frictional force due to axial reciprocating motion of these rollers during resting of the form dampening roller to cause deformation in the form dampening roller and/or these rollers. Such deformation of the rollers may cause an uneven contour of the form dampening roller onto the plate surface to degrade quality of print.

To avoid degradation of printing quality, it becomes necessary to replace the form dampening roller or other rollers in a short period thus raising running cost.

SUMMARY OF THE INVENTION

Therefore, it is an object of the present invention to provide a roller shifting device which can shift a plurality of rollers toward and away from a form dampening roller in conjunction with or in synchronism with shifting of the form dampening roller toward and away from a surface of a plate on a plate cylinder.

In order to accomplish the above-mentioned and other objects, a roller shifting device for a printing press, according to one aspect of the present invention, comprises:

first support means for supporting a form dampening roller for shifting the form dampening roller relative to a surface of a plate on a plate cylinder, between a first contacting position and a second released position;

second support means for supporting a transfer roller for shifting the transfer roller relative to the form dampening roller between a first contacting position and a second released position;

third support means for supporting another roller other than the transfer roller and to be contacted and released to the form dampening roller, for shifting the another roller between a first contacting position and a second released position;

means for cooperating the first, second and third support means for synchronous shifting between the first and second positions;

means for differentiating a shifting stroke of the first support means from those of the second and third support means; and actuating means associated one of the first, second and third means for driving to shift the first, second and third support means in synchronism with each other.

At least one of the first support means and the second support means may be formed integrally with the third support means. Also, one of the first, second and third support means may integrally incorporate a part of the cooperating means.

In the preferred construction, the cooperating means comprises a first component cooperating two of the first, second and third support means and a second component cooperating the other two of the first, second and third support means. The differentiating means may comprise means for accommodating a given shifting stroke of the second and/or third support means for providing a smaller shifting stroke for the first support means than that of the second and/or third support means. In the alternative, the differentiating means may comprise means for delaying shifting initiation timing of the first support means relative to shift initiation timing of the second and/or third means for providing a smaller shifting stroke for the first support means than that of the second and/or third support means.

According to another aspect of the invention, a roller shifting device for an inking system of a printing press comprises:

first means for carrying a first roller for shifting the latter between a first contacting position contacting onto a plate surface of a plate mounted on a plate cylinder, and a predetermined second released position shifted away from a plate surface, the first and second positions being distanced a predetermined first distance;

second means for carrying a second roller for shifting the latter between a first contacting position contacting onto the peripheral surface of the first roller and a predetermined second released position shifted away from the peripheral surface, the first and second positions being distanced a predetermined second distance;

third means for carrying a third roller for shifting the latter between a first contacting position contacting onto the peripheral surface of the first roller and a predetermined second released position shifted away from the peripheral surface, the first and second positions being distanced a predetermined third distance;

fourth means mechanically connected to one of the first, second and third means for driving the connected one of the first, second and third means between the first and second positions thereof over the corresponding one of the first, second and third distances;

fifth means for mechanically cooperating one of remaining two of the first, second and third means other than that connected to the fourth means with the one of first, second and third means connected to the fourth means, for transferring an actuation force of the fourth means for shifting between the first and second positions thereof over the corresponding one of the first, second and third distances; and sixth means for mechanically cooperating the other of a remaining two of the first, second and third means other than that connected to the fourth means with the one of first, second and third means connected to the fourth means, for transferring an actuation force of the fourth means for shifting between the first and second positions thereof over the corresponding one of the first, second and third distances.

In the preferred construction, the second distance of the second means is greater than at least the first distance of the first means, and the one of the fifth and sixth means cooperating the first and second means includes stroke accommodating means for accommodating the actuation stroke of the fourth means in a magnitude corresponding to a difference between the second and first distances. It may also be possible that the second distance of the second means is greater than at least the third distance of the first means, and the one of the fifth and sixth means cooperating the third and second means includes stroke accommodating means for accommodating the actuation stroke of the fourth means in a magnitude corresponding to a difference between the second and third distances.

According to a further aspect of the invention, a roller shifting device for an inking system of a printing press comprises:

first means for carrying a first roller for shifting the latter between a first contacting position contacting onto a plate surface of a plate mounted on a plate cylinder, and a predetermined second released position shifted away from a plate surface;

second means for carrying a second roller for shifting the latter between a first contacting position contacting onto the peripheral surface of the first roller and a predetermined second released position shifted away from the peripheral surface;

third means for carrying a third roller for shifting the latter between a first contacting position contacting onto the peripheral surface of the first roller and a predetermined second released position shifted away from the peripheral surface;

fourth means mechanically connected to the second means for driving the second means between the first and second positions;

fifth means mechanically cooperated with the first means for transferring actuation force of the fourth means to the latter at a given first timing relative to the initiation timing of actuation of the fourth means; and sixth means for mechanically cooperating the third means for transferring an actuation force of the fourth means to the latter at a given second timing relative to the initiation timing of actuation of the fourth means.

In the preferred embodiment, the first timing of the fifth means is delayed relative to the initiation timing of the fourth means for a given first delay period. Preferably, the first delay period corresponds to a given shifting stroke difference between the second means and the first means. It is also possible that the second timing of the sixth means is delayed relative to the initiation timing of the fourth means for a given second delay period. In this case, the second delay period may correspond to a given shifting stroke difference between the second means and the third means.

BRIEF DESCRIPTION OF THE DRAWINGS

The present invention will be understood more fully from the detailed description given herebelow and from the accompanying drawings of the preferred embodiments of the invention, which, however, should not be taken as limiting to the invention, but are for explanation and understanding only.

In the drawings.

DESCRIPTION OF THE PREFERRED EMBODIMENTS

Figure 1:
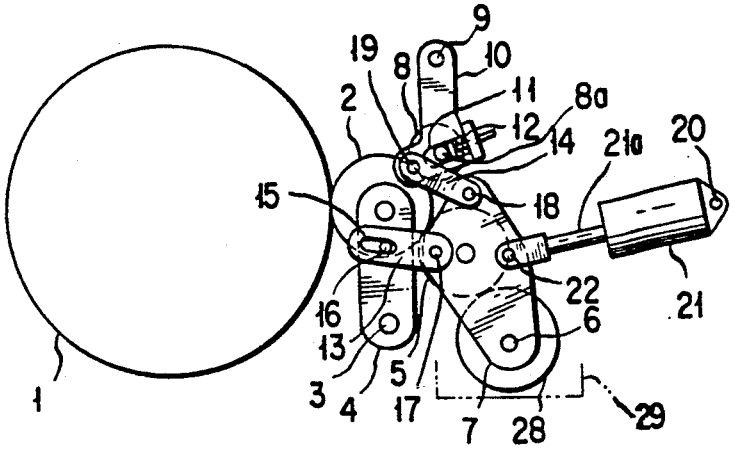
FIG. 1 is a fragmentary illustration showing the first embodiment of a roller shifting device according to the present invention, in a contacting condition.

The preferred embodiments of a roller shifting device, according to the present invention will be discussed herebelow with reference to FIGS. 1 to 10. The first to fifth embodiments illustrated in FIGS. 1 to 10 are directed to a dampening system for a printing press. In the drawings, the figures given odd figure numbers illustrate a contacting condition, where a form dampening roller contacts with a plate surface on a plate cylinder and a transfer roller and a rider roller as one example of other rollers contact with the form dampening roller. The figures given even figure numbers illustrate a released condition, where the form dampening roller is shifted away from the plate surface and the transfer roller and the rider roller are shifted away from the form dampening roller. It should be noted although only a rider roller is illustrated as an example of the other roller, the roller to be shifted together with the transfer roller can be an intermediate roller, such as a vibration roller. Furthermore, although the shown embodiments disclose shifting of only one other roller, i.e., a rider roller, the present invention should be applicable for shifting more than one roller, i.e. the rider roller, the intermediate roller, the vibration roller and so forth.

Figure 2:
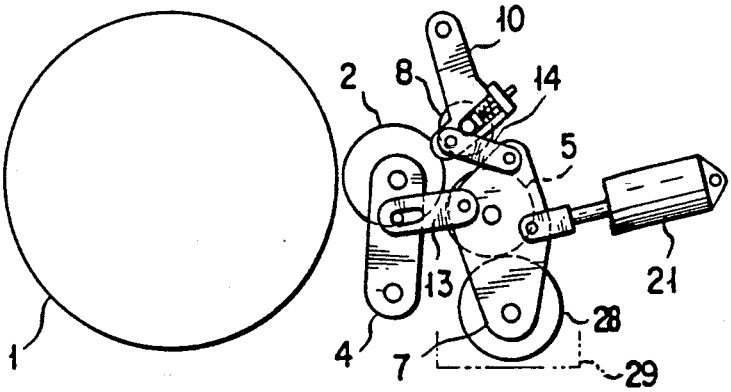
FIG. 2 is a fragmentary illustration showing the first embodiment of the roller shifting device in a released condition.

Referring to FIGS. 1 and 2, a form dampening roller 2 is supported by a first support member 4 which is pivotable about a pivot shaft 3. The first support member 4 pivots while carrying the form dampening roller 2 for contacting with and releasing away from a surface of a plate (not shown) mounted on a plate cylinder 1.

A transfer roller 5 is supported by a second support member 7 which is pivotable above a pivot shaft 6. The second support member 7 carries the transfer roller 5 for contacting with and releasing away from the peripheral surface of the form dampening roller 2. A rider roller 8 as an example of another roller contacting with the form dampening roller, is supported by a third support member 10 which is pivotable about a pivot shaft 9. The third support member 10 pivots while carrying the rider roller 8 for contacting with and releasing away from the outer periphery of the form dampening roller 2. As can be seen from FIG. 1, a roller shaft 8*a* of the rider roller 8 is loosely engaged to a cut-out elongated slot 11 formed in the third support member 10 for sliding movement therealong. A compression spring 12, without limitation, is arranged in the elongated slot 11 for biasing the roller shaft 8*a* toward the form dampening roller 2 in order to ensure contact of the rider roller 8 onto the periphery of the form dampening roller.

The first and second support members 4 and 7 are linked by a first linkage lever 13. On the other hand, the second and third support members 7 and 10 are linked by a second linkage lever 14. The first linkage lever 13 is formed with an axially extending elongated slot 15 in the vicinity of one end thereof. A pin 16 extending from the first support member 4 loosely engages with the elongated slot 15. On the other hand, the second linkage lever 14 pivotally engages with a pin 18 extending from the second support member 7 at one end and with a pin 19 extending from the third support member 10 at the other end.

In addition, an actuation cylinder 21, which is mounted on a frame (not shown) in a pivotal fashion for pivotal movement about a pivot pin 20, is connected to the second support member 7. An actuation rod 21*a* of the actuation cylinder 21 has a tip end pivotally connected to the second support member 7 for relative pivotal displacement.

With the construction set forth above, while the actuation rod 21*a* of the actuation cylinder 21 is maintained at the extracted position as shown in FIG. 1, the first support member 4 is maintained at a contacting position to establish contact between the form dampening roller 2 and the plate surface of the plate cylinder 1. At the same time, the second and third support members 7 and 10 are held at the contacting positions to establish contact between the form dampening roller 2 and the transfer and rider rollers 5 and 8. From this position, the actuation rod 21*a* is retracted to the release position, as shown in FIG. 2; then, the second support member 7 is pulled in a direction shifting the transfer roller 5 away from the form dampening roller 2. At the initial retraction stroke of the actuation rod 21*a* corresponding to the length of the elongated slot 15, the first linkage lever 13 is shifted with the second support member 7 without applying the retracting force to the first support member 4. Therefore, the first support member 4 with the form dampening roller 2 is held at the contacting position. At the same time, the third support member 10 connected to the second support member 7 via the second linkage lever 14 is pivoted in the direction toward the releasing position. At the initial stage of this pivotal motion of the third support member 10, the rider roller 8 is held in contact with the periphery of the form dampening roller 2 until the roller shaft 2*a* as biased by the compression spring 12 comes in contact with the edge of the elongated slot 11.

By a further retracting stroke of the actuation rod 21*a* of the actuation cylinder 21, the rider roller 8 is carried by the third support member 10 and shifted away from the peripheral surface of the form dampening roller 2. Also, after the initial stroke, the form dampening roller 2 is carried by the first support member pulled in the releasing direction by the first linkage lever 13 to be shifted away from the plate surface of the plate cylinder 1. As can be clear herefrom, the stroke of pivotal motion of the first support member 4 is smaller than that of the second support member 7 in a magnitude corresponding to the length of the elongated slot 15 of the first linkage lever 13. Also, the pivoting stroke of the third supporting member 10 is smaller than that of the second support member 7 in a magnitude corresponding to the stroke of the roller shaft 8*a* within the elongated slot 11. Then, at the end of the retracting stroke of the actuation rod 21*a*, the first, second and third supporting members 4, 7 and 10 are placed at respective released positions as illustrated in FIG. 2.

When the actuation rod 21*a* of the actuation cylinder 21 is actuated to the extracting position as shown in FIG. 1, respective components are shifted in the opposite directions to place the first, second and third support members 4, 7 and 10 at the contacting positions.

Figure 3:
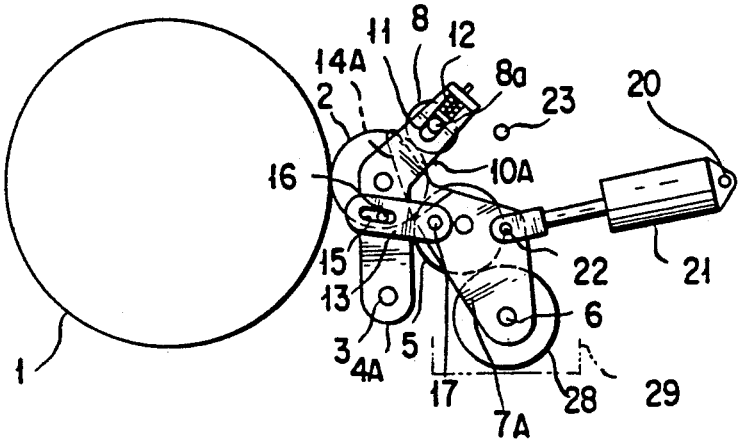
FIG. 3 is a fragmentary illustration showing the second embodiment of a roller shifting device according to the present invention, in a contacting condition.
Figure 4:
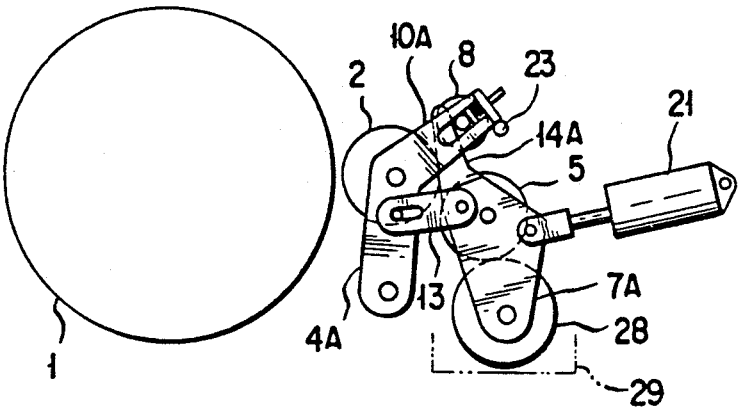
FIG. 4 is a fragmentary illustration showing the second embodiment of the roller shifting device in a released condition.

Referring to FIGS. 3 and 4, the second embodiment of the roller shifting device, according to the present invention, will be discussed. In the following discussion, common components to the foregoing first embodiment will be represented by the same reference numerals. In the shown construction, the form dampening roller 2 is supported by a first support member 4A which is pivotable about the pivot shaft 3. Similarly to the first embodiment, the first support member 4A pivots with carrying the form dampening roller 2 for contacting with and releasing away from the surface of the plate (not shown) mounted on the plate cylinder 1.

The transfer roller 5 is supported by a second support member 7A which is pivotable about the pivot shaft 6. The second support member 7A carries the transfer roller 5 for contacting with and releasing away from the peripheral surface of the form dampening roller 2. The rider roller 8 is supported by a third support member 10A which is formed integrally with the first support member and is pivotable about the pivot shaft 3. As can be seen from FIG. 3, the roller shaft 8*a* of the rider roller 8 is loosely engaged to a cut-out elongated slot 11 formed in the third support member 10A for sliding movement therealong. The compression spring 12, without limitation, is arranged in the elongated slot 11 for biasing the roller shaft 8*a* toward the form dampening roller 2 in order to ensure contact of the rider roller 8 onto the periphery of the form dampening roller.

The first and second support members 4A and 7A are linked by the first linkage lever 13. On the other hand, the second and third support members 7A and 10A are cooperated by a cooperating piece 14A which is integrally extended from the second support member 7A and adapted to contact with the roller shaft 8*a* during pivotal movement of the second support member. The first linkage lever 13 is formed with the axially extending elongated slot 15 in the vicinity of one end thereof. The pin 16 extending from the first support member 4A loosely engages with the elongated slot 15. The actuation cylinder 21, pivotable about the pivot pin 20, is connected to the second support member 7A. The actuation rod 21*a* of the actuation cylinder 21 has the tip end pivotally connected to the second support member 7A for relative pivotal displacement.

With the construction set forth above, while the actuation rod 21*a* of the actuation cylinder 21 is maintained at the extracted position as shown in FIG. 3, the first support member 4A is maintained at the contacting position to establish contact between the form dampening roller 2 and the plate surface of the plate cylinder 1. At the same time, the second and third support members 7A and 10A are held at the contacting positions to establish contact between the form dampening roller 2 and the transfer and rider rollers 5 and 8. From this position, the actuation rod 21*a* is retracted to the release position, as shown in FIG. 4, then, the second support member 7A is pulled in a direction shifting the transfer roller 5 away from the form dampening roller 2. At the initial retraction stroke of the actuation rod 21*a* corresponding to the length of the elongated slot 15, the first linkage lever 13 is shifted with the second support member 7A without acting the retracting force to the first support member 4A. Therefore, the first support member 4A with the form dampening roller 2 is held at the contacting position. At the same time, the third support member 10A as formed integrally with the first support member is maintained at the contacting position. At this initial stage, the cooperating piece 14A formed integrally with the second support member 7A comes into contact with the roller shaft 8*a* to shift the latter relative to the elongated slot 11 while compressing the compression spring 12. The rider roller 8 is held in contact with the periphery of the form dampening roller 2 until the spring 12 is fully compressed.

By a further retracting stroke of the actuation rod 21*a* of the actuation cylinder 21, the rider roller 8 is carried by the third support member 10A and shifted away from the peripheral surface of the form dampening roller 2. Also, after the initial stroke, the form dampening roller 2 is carried by the first support member pulled in the releasing direction by the first linkage lever 13 to be shifted away from the plate surface of the plate cylinder 1. As can be clear herefrom, the stroke of pivotal motion of the first support member 4A is smaller than that of the second support member 7A in a magnitude corresponding to the length of the elongated slot 15 of the first linkage lever 13. Also, the pivoting stroke of the third supporting member 10A is smaller than that of the second support member 7A in a magnitude corresponding to the stroke of the roller shaft 8*a* within the elongated slot 11. Then, at the end of the retracting stroke of the actuation rod 21*a*, the first, second and third supporting members 4A, 7A and 10A are placed at respective released positions as illustrated in FIG. 4.

When the actuation rod 21*a* of the actuation cylinder 21 is actuated to the extracting position as shown in FIG. 3, respective components is shifted in the opposite directions to place the first, second and third support members 4A, 7A and 10A at the contacting positions.

Figure 5:
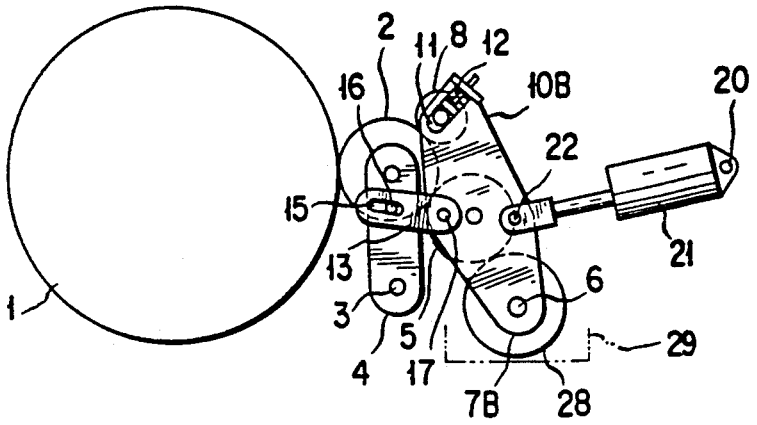
FIG. 5 is a fragmentary illustration showing the third embodiment of a roller shifting device according to the present invention, in a contacting condition.
Figure 6:
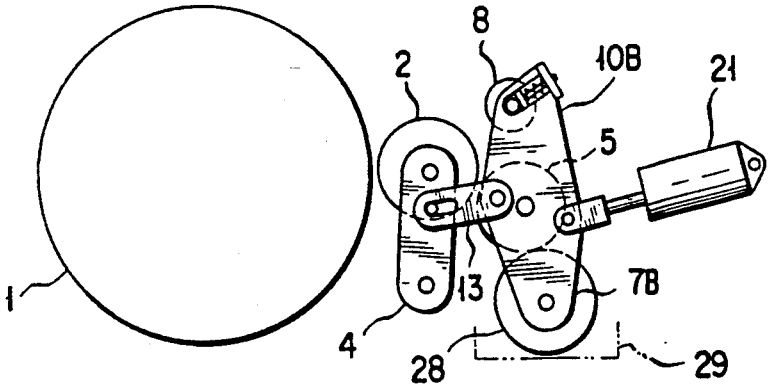
FIG. 6 is a fragmentary illustration showing the third embodiment of the roller shifting device in a released condition.

Referring to FIGS. 5 and 6, the third embodiment of the roller shifting device, according to the present invention, will be discussed. In the following discussion, common components to the foregoing first embodiment will be represented by the same reference numerals. In the shown construction, the form dampening roller 2 is supported by a first support member 4 which is pivotable about the pivot shaft 3 in the same manner as that in the first embodiment. The first support member 4 pivots while carrying the form dampening roller 2 for contacting with and releasing away from the surface of the plate (not shown) mounted on the plate cylinder 1.

The transfer roller 5 is supported by a second support member 7B which is pivotable about the pivot shaft 6. The second support member 7B carries the transfer roller 5 for contacting with and releasing away from the peripheral surface of the form dampening roller 2. The rider roller 8 is supported by a third support member 10B which is formed integrally with the second support member 7B and is pivotable about the pivot shaft 6. As can be seen from FIG. 5, the roller shaft 8*a* of the rider roller 8 is loosely engaged to a cut-out elongated slot 11 formed in the third support member 10B for sliding movement therealong. The compression spring 12, without limitation, is arranged in the elongated slot 11 for biasing the roller shaft 8*a* toward the form dampening roller 2 in order to ensure contact of the rider roller 8 onto the periphery of the form dampening roller.

The first and second support members 4 and 7B are linked by the linkage lever 13. The linkage lever 13 is formed with the axially extending elongated slot 15 in the vicinity of one end thereof. The pin 16 extending from the first support member 4 loosely engages with the elongated slot 15. The actuation cylinder 21, pivotable about the pivot pin 20, is connected to the second support member 7B. The actuation rod 21*a* of the actuation cylinder 21 has the tip end pivotally connected to the second support member 7B for relative pivotal displacement.

With the construction set forth above, while the actuation rod 21*a* of the actuation cylinder 21 is maintained at the extracted position as shown in FIG. 5, the first support member 4 is maintained at the contacting position to establish contact between the form dampening roller 2 and the plate surface of the plate cylinder 1. At the same time, the second and third support members 7B and 10B are held at the contacting positions to establish contact between the form dampening roller 2 and the transfer and rider rollers 5 and 8. From this position, the actuation rod 21*a* is retracted to the release position, as shown in FIG. 6; then, the second support member 7B is pulled in a direction shifting the transfer roller 5 away from the form dampening roller 2. At the initial retraction stroke of the actuation rod 21*a* corresponding to the length of the elongated slot 15, the linkage lever 13 is shifted with the second support member 7B without acting the retracting force to the first support member 4. Therefore, the first support member 4 with the form dampening roller 2 is held at the contacting positions. At the same time, the third support member 10B as formed integrally with the second support member 7B is shifted away from the contacting position. At this initial stage, the roller shaft 8*a* is shifted along the elongated slot 11. The rider roller 8 is held in contact with the periphery of the form dampening roller 2 until the roller shaft 8*a* comes into contact with the edge of the elongated slot 11.

By a further retracting stroke of the actuation rod 21*a* of the actuation cylinder 21, the rider roller 8 is carried by the third support member 10B and shifted away from the peripheral surface of the form dampening roller 2. Also, after the initial stroke, the form dampening roller 2 is carried by the first support member pulled in the releasing direction by the linkage lever 13 to be shifted away from the plate surface of the plate cylinder 1. As is clear herefrom, the stroke of pivotal motion of the first support member 4 is smaller than that of the second support member 7B in a magnitude corresponding to the length of the elongated slot 15 of the linkage lever 13. Also, the pivoting stroke of the third supporting member 10B is smaller than that of the second support member 7B in a magnitude corresponding to the stroke of the roller shaft 8*a* within the elongated slot 11. Then, at the end of the retracting stroke of the actuation rod 21*a*, the first, second and third supporting members 4, 7B and 10B are placed at respective released positions as illustrated in FIG. 6.

When the actuation rod 21*a* of the actuation cylinder 21 is actuated to the extracting position as shown in FIG. 5, respective components are shifted in the opposite directions to place the first, second and third support members 4, 7B and 10B at the contacting positions.

Figure 7:
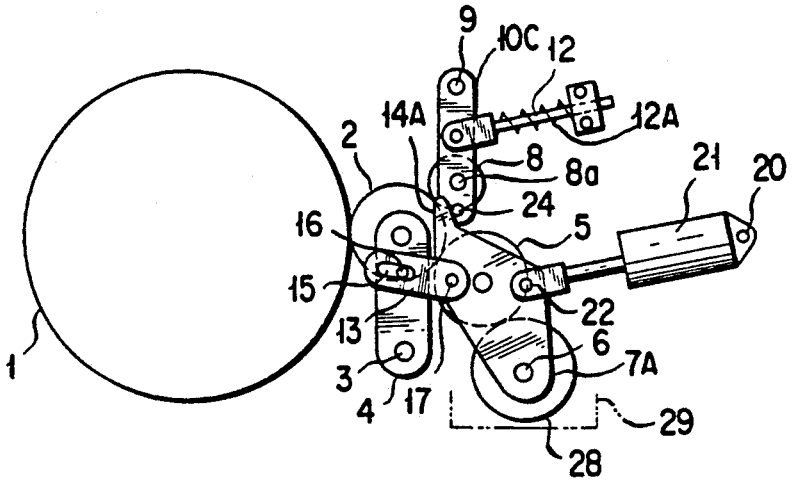
FIG. 7 is a fragmentary illustration showing the fourth embodiment of a roller shifting device according to the present invention, in a contacting condition.
Figure 8:
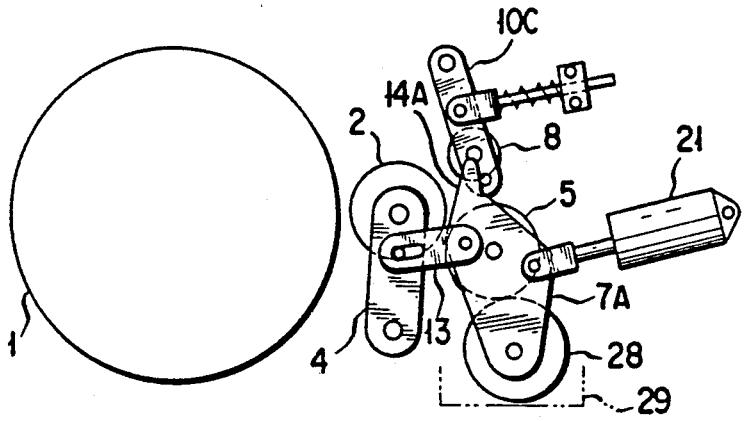
FIG. 8 is a fragmentary illustration showing the fourth embodiment of the roller shifting device in a released condition.

Referring to FIGS. 7 and 8, the fourth embodiment of the roller shifting device, according to the present invention, will be discussed. In the following discussion, common components to the foregoing first embodiment will be represented by the same reference numerals. In the shown construction, the form dampening roller 2 is supported by a first support member 4 which is pivotable about the pivot shaft 3 in the same manner as that in the first embodiment. The first support member 4 pivots while carrying the form dampening roller 2 for contacting with and releasing away from the surface of the plate (not shown) mounted on the plate cylinder 1.

The transfer roller 5 is supported by the second support member 7A which is pivotable above the pivot shaft 6. The second supporting member 7A is formed into substantially the same construction as that of the foregoing second embodiment. The second support member 7A carries the transfer roller 5 for contacting with and releasing away from the peripheral surface of the form dampening roller 2. The rider roller 8 is supported by a third support member 10C which is pivotable about the pivot shaft 9. A spring biased rod 12A is connected to the intermediate portion of the third support member 10C. The compression spring 12 is wound around the rod 12A for normally biasing the third support member 10C toward the contacting position. The third support member 10C further carries a contact pin 24 extending from one end thereof.

The first and second support members 4 and 7A are linked by the linkage lever 13. On the other hand, the second and third support members 7A and 10C are cooperated by a cooperating piece 14A which is integrally extended from the second support member 7A and adapted to contact with the contact pin 24 during pivotal movement of the second support member. The linkage lever 13 is formed with the axially extending elongated slot 15 in the vicinity of one end thereof. The pin 16 extending from the first support member 4 loosely engages with the elongated slot 15. The actuation cylinder 21 pivotable the pivot pin 20, is connected to the second support member 7A. The actuation rod 21*a* of the actuation cylinder 21 has the tip end pivotally connected to the second support member 7A for relative pivotal displacement.

With the construction set forth above, while the actuation rod 21*a* of the actuation cylinder 21 is maintained at the extracted position as shown in FIG. 7, the first support member 4 is maintained at the contacting position to establish contact between the form dampening roller 2 and the plate surface of the plate cylinder 1. At the same time, the second and third support member 7A and 10C are maintained at the contacting position. From this position, the actuation rod 21*a* is retracted to the release position, as shown in FIG. 8; then, the second support member 7A is pulled in a direction shifting the transfer roller 5 away from the form dampening roller 2. At the initial retraction stroke of the actuation rod 21*a* corresponding to the length of the elongated slot 15, the linkage lever 13 is shifted with the second support member 7A without applying the retracting force to the first support member 4. Therefore, the first support member 4 with the form dampening roller 2 is held at the contacting position. At this initial stage, the cooperating piece 14A formed integrally with the second support member 7A comes into contact with the contact pin 24 to shift the latter against the spring force of the compression spring 12.

The rider roller 8 is held in contact with the periphery of the form dampening roller 2 until the cooperating piece 14A urges the third support plate 10C via the contact pin 24 in the releasing direction.

By a further retracting stroke of the actuation rod 21*a* of the actuation cylinder 21, the rider roller 8 is carried by the third support member 10C and shifted away from the peripheral surface of the form dampening roller 2. Also, after the initial stroke, the form dampening roller 2 is carried by the first support member pulled in the releasing direction by the linkage lever 13 to be shifted away from the plate surface of the plate cylinder 1. As can be clear herefrom, the stroke of pivotal motion of the first support member 4 is smaller than that of the second support member 7A in a magnitude corresponding to the length of the elongated slot 15 of the linkage lever 13. Also, the pivoting stroke of the third supporting member 10C is smaller than that of the second support member 7A in a magnitude corresponding to the stroke of the roller shaft 8*a* within the elongated slot 11. Then, at the end of the retracting stroke of the actuation rod 21*a*, the first, second and third supporting members 4, 7A and 10C are placed at respective released positions as illustrated in FIG. 8.

When the actuation rod 21*a* of the actuation cylinder 21 is actuated to the extracting position as shown in FIG. 7, respective components is shifted in the opposite directions to place the first, second and third support members 4, 7A and 10C at the contacting positions.

Figure 9:
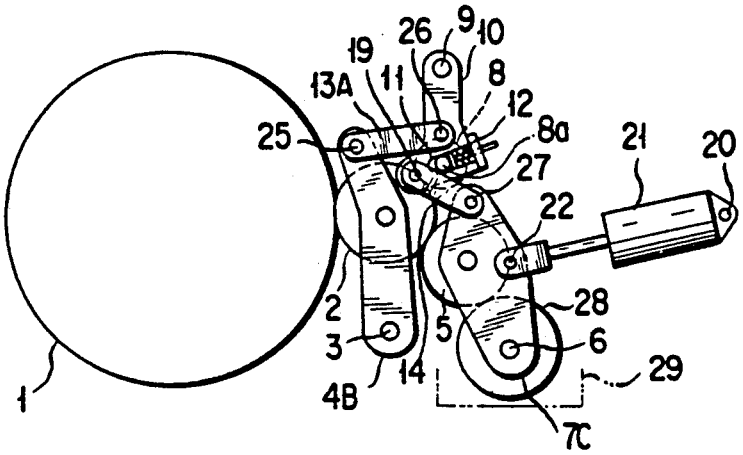
FIG. 9 is a fragmentary illustration showing the fifth embodiment of a roller shifting device according to the present invention, in a contacting condition.
Figure 10:
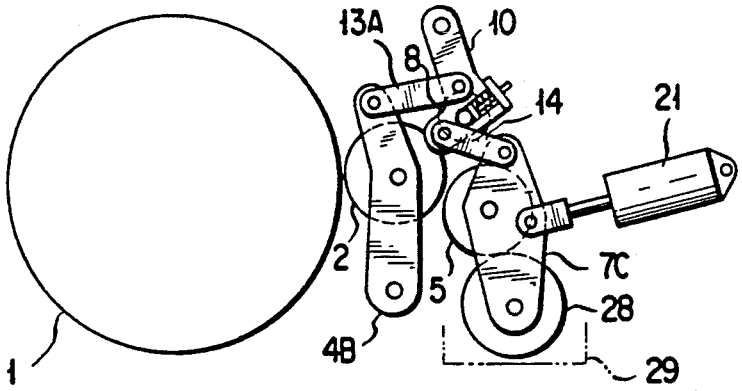
FIG. 10 is a fragmentary illustration showing the fifth embodiment of the roller shifting device in a released condition.
Figure 11:
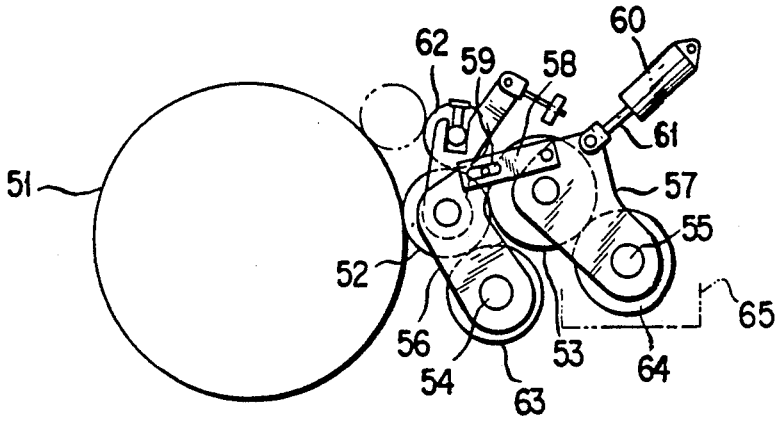
FIG. 11 PRIOR ART
FIG. 11 is a fragmentary illustration showing the conventional roller shifting device in a contacting condition.

Referring to FIGS. 9 and 10, the fifth embodiment of the roller shifting device according to the present invention will be discussed. The form dampening roller 2 is supported by a first support member 4B which is pivotable about a pivot shaft 3. The first support member 4B pivots while carrying the form dampening roller 2 for contacting with and releasing away from a surface of a plate (not shown) mounted on a plate cylinder 1.

The transfer roller 5 is supported by a second support member 7C which is pivotable about the pivot shaft 6. The second support member 7C carries the transfer roller 5 for contacting with and releasing away from the peripheral surface of the form dampening roller 2. The rider roller 8 is supported by the third support member 10 which is pivotable about a pivot shaft 9. The third support member 10 pivots while carrying the rider roller 8 for contacting with and releasing away from the outer periphery of the form dampening roller 2. As can be seen from FIG. 9, a roller shaft 8*a* of the rider roller 8 is loosely engaged to a cutout elongated slot 11 formed in the third support member 10 for sliding movement therealong. A compression spring 12, without limitation, is arranged in the elongated slot 11 for biasing the roller shaft 8*a* toward the form dampening roller 2 in order to ensure contact of the rider roller 8 onto the periphery of the form dampening roller.

The first and third support members 4B and 10 are linked by a first linkage lever 13A. On the other hand, the second and third support members 7C and 10 are linked by a second linkage lever 14. The first linkage lever 13A is engaged to a pin 25 extending from the first support member 4B at one end and to a pin 26 extending from the third support member at the other end. Similarly, the second linkage lever 14 is engaged to the pin 19 extending from the third support member 10 at one end and to a pin 27 extending from the second support member 7C at the other end.

The actuation cylinder 21, which is mounted on a frame (not shown) in a pivotal fashion for pivotal movement about a pivot pin 20, is connected to the second support member 7C. An actuation rod 21*a* of the actuation cylinder 21 has a tip end pivotally connected to the second support member 7C for relative pivotal displacement.

With the construction set forth above, while the actuation rod 21*a* of the actuation cylinder 21 is maintained at the extracted position as shown in FIG. 9, the first support member 4B is maintained at a contacting position to establish contact between the form dampening roller 2 and the plate surface of the plate cylinder 1. At the same time, the second and third support members 7C and 10 are held at the contacting positions to establish contact between the form dampening roller 2 and the transfer and rider rollers 5 and 8. From this position, the actuation rod 21*a* is retracted to the release position, as shown in FIG. 10. Then, the second support member 7C is pulled in a direction shifting the transfer roller 5 away from the form dampening roller 2. At the same time, the third support member 10 connected to the second support member 7 via the second linkage lever 14 is pivoted in the direction toward the releasing position. At the initial stage of this pivotal motion of the third support member 10, the rider roller 8 is held in contact with the periphery of the form dampening roller 2 until the roller shaft 2*a* as biased by the compression spring 12 comes in contact with the edge of the elongated slot 11. During this initial retraction stroke of the actuation rod 21*a*, the first linkage lever 13 is not shifted until the third support member 10 is shifted. Therefore, the first support member 4 with the form dampening roller 2 is held at the contacting positions.

By a further retracting stroke of the actuation rod 21*a* of the actuation cylinder 21, the rider roller 8 is carried by the third support member 10 and shifted away from the peripheral surface of the form dampening roller 2. Also, after the initial stroke, the form dampening roller 2 is carried by the first support member pulled in the releasing direction by the first linkage lever 13 to be shifted away from the plate surface of the plate cylinder 1. As can be clear herefrom, the stroke of pivotal motion of the first support member 4B is smaller than that of the second support member 7C in a magnitude corresponding to the length of the elongated slot 11. Also, the pivoting stroke of the third supporting member 10 is smaller than that of the second support member 7C in a magnitude corresponding to the stroke of the roller shaft 8*a* within the elongated slot 11. Then, at the end of the retracting stroke of the actuation rod 21*a*, the first, second and third supporting members 4B, 7C and 10 are placed at respective released positions as illustrated in FIG. 10.

When the actuation rod 21*a* of the actuation cylinder 21 is actuated to the extracting position as shown in FIG. 9, respective components are shifted in the opposite directions to place the first, second and third support members 4B, 7C and 10 at the contacting positions.

As can be appreciated herefrom, according to the present invention, it becomes possible to shift more than one roller contacting with the form dampening roller toward and away from the latter in conjunction with shifting of the form dampening roller toward and away from the plate surface of the plate cylinder.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

For instance, in the embodiments of FIGS. 1 through 10, the first support members 4, 4A, 4B and the second support members 7, 7A, 7B, 7C may have common pivots. Also, in the embodiments illustrated in FIGS. 1 through 8, it may be possible to provide a loose connection between the linkage lever 13 and the second support members 7, 7A, 7b. Furthermore, in the embodiment illustrated in FIGS. 9 and 10, it may be possible to provide a loose connection at least at one portion in connections between the linkage levers 13A and 14 and respective ones of the support members 4B, 7C and 10. Also, in the embodiment of FIGS. 5 and 6, it is possible to cooperate the first and third support means 4 and 10B by the first linkage lever 13. In the embodiment of FIGS. 7 and 8, it may be possible to cooperate the cooperating piece 14A to act on the roller shaft 8*a* of the rider roller 8. In addition, in the embodiment of FIGS. 1 through 10, any appropriate drive means may be employed in place of the actuation cylinder 21. Furthermore, the means to be mechanically connected to the drive means may be replaced with any appropriate means from the second support member 7, 7A, 7B, 7C. Namely, in the embodiments of FIGS. 1 to 4, the drive means can be connected to either of the third support member 10, 10A, the first linkage lever 13 or the cooperating means 14, 14A. In the case of the embodiment of FIGS. 5 and 6, the drive means may be mechanically connected to either of the third support member 10B or the linkage lever 13. In the case of the embodiment of FIGS. 7 and 8, the drive means may be mechanically connected to either the linkage lever 13 or the connecting piece 14A. Furthermore, in the case of the embodiment of FIGS. 9 and 10, the drive means can be mechanically connected to either of the first support member 4, the third support member 10, the linkage lever 13 or the linkage lever 14.

Furthermore, in the embodiments of FIGS. 1 to 10, it is possible to avoid the compression springs 12 and to assure contact of the rider rollers onto the form dampening rollers by its own gravity weight.

What is claimed is:

1. A roller shifting device for a printing press comprising:

first support means for supporting a form roller for shifting said form roller relative to a surface of a plate on a plate cylinder between a first contacting position and a second released position;

second support means for supporting a transfer roller for shifting said transfer roller relative to said form roller between a first contacting position and a second released position;

third support means for supporting another roller other than said transfer roller and to be contacted with and released from said form roller, for shifting said another roller between a first contacting position and a second released position;

means for cooperating said first, second and third support means for synchronous shifting between said first and second positions;

means for differentiating a shifting stroke of said first support means from those of said second and third support means; and actuating means associated with one of said first, second and third means for driving to shift said first, second and third support means in synchronism with each other.

2. A roller shifting device as set forth in claim 1, wherein at least one of said first support means and said second support means is formed integrally with said third support means.

3. A roller shifting device as set forth in claim 1, wherein one of said first, second and third support means integrally incorporates a part of said cooperating means.

4. A roller shifting device as set forth in claim 1, wherein said cooperating means comprises a first component cooperating two of said first, second and third support means and a second component cooperating another two of said first, second and third support means.

5. A roller shifting device as set forth in claim 1, wherein said differentiating means comprises means for accommodating a given shifting stroke of said second and/or third support means for providing a smaller shifting stroke for said first support means than that of said second and/or third support means.

6. A roller shifting device as set forth in claim 1, wherein said differentiating means comprises means for delaying shifting initiation timing of said first support means relative to shifting initiation timing of said second and/or third means for providing a smaller shifting stroke for said first support means than that of said second and/or third support means.

7. A roller shifting device for an inking system of a printing press comprising:

first means for carrying a first roller for shifting the first roller between a first contacting position contracting onto a plate surface of a plate mounted on a plate cylinder and a predetermined second released position shifted away from a plate surface, said first and second positions being distanced at a predetermined first distance;

second means for carrying a second roller for shifting the second roller between a first contacting position contacting onto the peripheral surface of said first roller and a predetermined second released position shifted away from said peripheral surface, said first and second positions being distanced at a predetermined second distance;

third means for carrying a third roller for shifting the latter between a first contacting position contacting onto the peripheral surface of said first roller and a predetermined second released position shifted away from said peripheral surface, said first and second positions being distanced at a predetermined third distance;

fourth means mechanically connected to one of said first, second and third means for driving the connected one of said first, second and third means between said first and second positions thereof over the corresponding one of said first, second and third distances;

fifth means for mechanically cooperating one of a remaining two of said first, second and third means other than that connected to said fourth means with said one of first, second and third means connected to said fourth means, for transferring an actuation force of said fourth means for shifting between said first and second positions thereof over the corresponding one of said first, second and third distances; and sixth means for mechanically cooperating the other of a remaining two of said first, second and third means other than that connected to said fourth means with said one of first, second and third means connected to said fourth means, for transferring actuation force of said fourth means for shifting between said first and second positions thereof over the corresponding one of said first, second and third distances.

8. A roller shifting device as set forth in claim 7, wherein said second distance of said second means is greater than at least said first distance of said first means, and said one of said fifth and sixth means cooperating with said first and second means includes stroke accommodating means for accommodating the actuation stroke of said fourth means in a magnitude corresponding to a difference between said second and first distances.

9. A roller shifting device as set forth in claim 8, wherein said second distance of said second means is greater than at least said third distance of said first means, and said one of said fifth and sixth means cooperating with said third and second means includes stroke accommodating means for accommodating the actuation stroke of said fourth means in a magnitude corresponding to a difference between said second and third distances.

10. A roller shifting device as set forth in claim 7, wherein said third means is integrated with one of said first and second means.

11. A roller shifting device as set forth in claim 7, wherein one of said fifth and sixth means is integrated with one of said first, second and third means.

12. A roller shifting device for an inking system of a printing press comprising:

first means for carrying a first roller for shifting the first roller between a first contacting position contacting onto a plate surface of a plate mounted on a plate cylinder and a predetermined second released position shifted away from a plate surface;

second means for carrying a second roller for shifting the second roller between a first contacting position contacting onto the peripheral surface of said first roller and a predetermined second released position shifted away from said peripheral surface;

third means for carrying a third roller for shifting the latter between a first contacting position contacting onto the peripheral surface of said first roller and a predetermined second released position shifted away from said peripheral surface;

fourth means mechanically connected to said second means for driving said second means between said first and second positions;

fifth means mechanically cooperated with said first means for transferring an actuation force of said fourth means to the first means at a given first timing relative to an initiation timing of actuation of said fourth means; and sixth means mechanically cooperating with said third means for transferring actuation force of said fourth means to the third means at a given second timing relative to the intiation timing of actuation of said fourth means.

13. A roller shifting device as set forth in claim 12, wherein said first timing of said fifth means is delayed relative to said initiation timing of said fourth means for a given first delay period.

14. A roller shifting device as set forth in claim 13, wherein said first delay period corresponds to a given shifting stroke difference between said second means and said first means.

15. A roller shifting device as set forth in claim 13, wherein said second timing of said sixth means is delayed relative to said initiation timing of said fourth means for a given second delay period.

16. A roller shifting device as set forth in claim 15, wherein said second delay period corresponds to a given shifting stroke difference between said second means and said third means.

17. A roller shifting device as set forth in claim 12, wherein said third means is integrated with one of said first and second means.

18. A roller shifting device as set forth in claim 12, wherein one of said fifth and sixth means is integrated with one of said first, second and third means.

* * * * *